US009080373B2

(12) United States Patent
Silk et al.

(10) Patent No.: US 9,080,373 B2
(45) Date of Patent: Jul. 14, 2015

(54) JAMB SYSTEM

(71) Applicant: Forest View Industries Ltd., Mississauga (CA)

(72) Inventors: Mark Silk, Mississauga (CA); Steve McElwee, Toronto (CA); Jeff Peebles, Etobicoke (CA)

( * ) Notice: Subject to any disclaimer, the term of this patent is extended or adjusted under 35 U.S.C. 154(b) by 0 days.

(21) Appl. No.: 13/972,996

(22) Filed: Aug. 22, 2013

(65) Prior Publication Data

US 2014/0053480 A1 Feb. 27, 2014

Related U.S. Application Data

(60) Provisional application No. 61/692,451, filed on Aug. 23, 2012.

(51) Int. Cl.
*E06B 1/04* (2006.01)
*E06B 1/20* (2006.01)
*E06B 1/30* (2006.01)

(52) U.S. Cl.
CPC .... *E06B 1/20* (2013.01); *E06B 1/30* (2013.01)

(58) Field of Classification Search
CPC ..... E04F 21/0007; E06B 1/02; E06B 1/52; E06B 1/30; E06B 1/32; E06B 1/20; E06B 1/08; E06B 1/10; E06B 1/04; E06B 1/347
USPC ..... 52/204.71, 204.72, 287.1, 288.1, 631, 52/204.1, 204.56, 213, 217
See application file for complete search history.

(56) References Cited

U.S. PATENT DOCUMENTS

| | | | | | |
|---|---|---|---|---|---|
| 2,736,930 | A | * | 3/1956 | Longley | 52/211 |
| 3,545,135 | A | * | 12/1970 | Lieber | 49/505 |
| 3,553,891 | A | * | 1/1971 | Casebolt et al. | 49/505 |
| 3,614,846 | A | * | 10/1971 | Donnelly | 52/213 |
| 3,757,473 | A | * | 9/1973 | Mundy | 49/380 |
| 3,800,488 | A | * | 4/1974 | Swanson | 52/212 |
| 3,808,759 | A | * | 5/1974 | Carmichael | 52/212 |
| 3,981,103 | A | * | 9/1976 | McAllister | 49/505 |
| 4,014,146 | A | | 3/1977 | DiMascio et al. | |
| 4,019,303 | A | * | 4/1977 | McAllister | 52/745.16 |
| 4,539,784 | A | | 9/1985 | Allen | |
| 4,787,184 | A | * | 11/1988 | Boidron | 52/217 |
| 4,878,325 | A | * | 11/1989 | Van Tuyl et al. | 52/217 |
| 4,912,879 | A | * | 4/1990 | Mozuras et al. | 49/505 |
| 5,365,708 | A | * | 11/1994 | Winston | 52/212 |
| 5,575,123 | A | * | 11/1996 | Adams | 52/212 |
| 5,735,326 | A | * | 4/1998 | Seidner | 144/350 |
| 5,787,660 | A | * | 8/1998 | Adams | 52/212 |

(Continued)

FOREIGN PATENT DOCUMENTS

WO WO9729267 8/1997

*Primary Examiner* — Brian Glessner
*Assistant Examiner* — Gisele Ford
(74) *Attorney, Agent, or Firm* — Miltons IP/p.i.

(57) ABSTRACT

A jamb system for attachment to a wall comprises a jamb member and a support. The support member is of variable width and has a first member and a second member. The first member is affixed directly to the jamb member. The second member is positioned between a portion of the first member and the jamb member, and the second member is lockingly engaged with the first member. The second member is directly adjacent to the jamb member, and the support member is affixable to the wall. The support member may comprise a one or more wing members for affixing the support member to the wall.

8 Claims, 11 Drawing Sheets

(56) References Cited

U.S. PATENT DOCUMENTS

| | | | | |
|---|---|---|---|---|
| 6,467,226 | B2 * | 10/2002 | Dodson et al. | 52/220.1 |
| 6,588,159 | B1 * | 7/2003 | Cotton, Jr. | 52/211 |
| 7,043,883 | B1 | 5/2006 | Cederberg et al. | |
| 7,516,581 | B2 * | 4/2009 | Vidal | 52/204.1 |
| 7,533,503 | B2 * | 5/2009 | Wang | 52/217 |
| 7,921,603 | B2 | 4/2011 | Darnell | |
| 8,087,208 | B2 | 1/2012 | Quintile et al. | |
| 2010/0212239 | A1 * | 8/2010 | Wang | 52/217 |

* cited by examiner

JAMB SYSTEM

TECHNICAL FIELD

The present invention relates to a jamb system and more particularly to a jamb system with adjustable width for use with a broad range of jamb and wall thickness.

BACKGROUND

U.S. Pat. No. 4,014,146 (DiMascio et al.) discloses an adjustable bracket for mounting a jamb to an adjacent framing member. The device includes at least one L-shaped member which is secured to the back of the jamb and to the surrounding frame. A second L-shaped member slides within the first, and is nailed to the surrounding frame.

U.S. Pat. No. 4,539,784 (Allen) discloses an adjustable device for anchoring door jambs of various sizes. The device includes a pair of overlapping L-shaped planar members in sliding engagement with each other. The overlapping members are retained by one or frame members (positioned perpendicular to the planar members), with each bracket having a lip formed along an outer edge thereof. of a horizontal portion to provide a slot for use in retaining the overlapping members.

U.S. Pat. No. 7,043,883 (Cederberg et al.) discloses a door jamb that consists of three elements: a pair of tubular side jambs and a tubular head jamb, Each element has an outer low maintenance element, an inner structural element, and an intermediate element for receiving a portion of each of the outer and inner elements to secure the same together. The three elements can be secured in a variety of positions to provide a desired depth of the door jamb.

U.S. Pat. No. 7,921,603 (Darnell) discloses a bracket set consisting of three pieces, including two L-shaped fixed brackets and an intumescent strip (or sheet) between the L-shaped brackets.

U.S. Pat. No. 8,087,208 (Quintile et al.) discloses a frame member fastening device, which is combined with another identical frame member fastening device to form a fastening device assembly for use with frame members of different internal widths. The two devices are interlocked in an opposed, base-to-base assembly configuration.

WO9729267 (Howlett) discloses a frame member fastening device, which is combined with another identical frame member fastening device to form a fastening device assembly for use with frame members of different internal widths. The two devices are interlocked in an opposed, base-to-base assembly configuration.

SUMMARY

The apparatus in its general form will first be described, and then its implementation in terms of embodiments will be detailed hereafter. These embodiments are intended to demonstrate the principle of the apparatus, and the manner of its implementation. The apparatus in its broadest and more specific forms will then be further described, and defined, in each of the individual claims which conclude this Specification.

In one aspect of the present apparatus, there is provided a jamb system for attachment to a wall, the jamb system comprising: a) a jamb member; and b) a support member of variable width, the support member having: i) a first member that is affixed directly to the jamb member; and ii) a second member that is positioned between a portion of the first member and the jamb member, the second member lockingly engaged with the first member; wherein the second member is directly adjacent to the jamb member, and the support member is affixable to the wall.

In another aspect of the present apparatus, there is provided door jamb system for attachment to a wall, the jamb system comprising: a) a jamb member; and b) a support member of variable width, the support member having: i) a first member that is affixed directly to the jamb member; and ii) a second member that is positioned between a portion of the first member and the jamb member, the second member lockingly engaged with the first member; wherein the second member is directly adjacent to the jamb member, and the support member comprises a plurality of wing members for affixing the support member to the wall.

In a further aspect of the present apparatus, there is provided jamb system for attachment to a wall of a window assembly, the jamb system comprising: a) a jamb member; and b) a support member of variable width, the support member having: i) a first member that is affixed directly to the jamb member; and ii) a second member that is positioned between a portion of the first member and the jamb member, the second member lockingly engaged with the first member; wherein the second member is directly adjacent to the jamb member, and the support member comprises a wing member for affixing the support member to the wall.

It is contemplated to use the jamb system for installation in an opening that does not use traditional casing. Where applicable, the system may be installed after the drywall is set. In addition, the system provides a consistent reveal.

The foregoing summarizes the principal features of the apparatus and some of its optional aspects. The invention may be further understood by the description of embodiments which follow.

Wherever ranges of values are referenced within this specification, sub-ranges therein are intended to be included within the scope of the apparatus unless otherwise indicated. Where characteristics are attributed to one or another variant of the apparatus, unless otherwise indicated, such characteristics are intended to apply to all other variants of the apparatus where such characteristics are appropriate or compatible with such other variants.

DETAILED DESCRIPTION

The following is given by way of illustration only and is not to be considered limitative of the apparatus. Many apparent variations are possible without departing from the scope thereof.

The system comprises two components: (1) a support member, that has an adjustable width; and (2) a jamb member. A first surface of the support member is affixed to the jamb member, while a second surface of the support member is affixable to surrounding drywall and wall stud.

Figure 1:
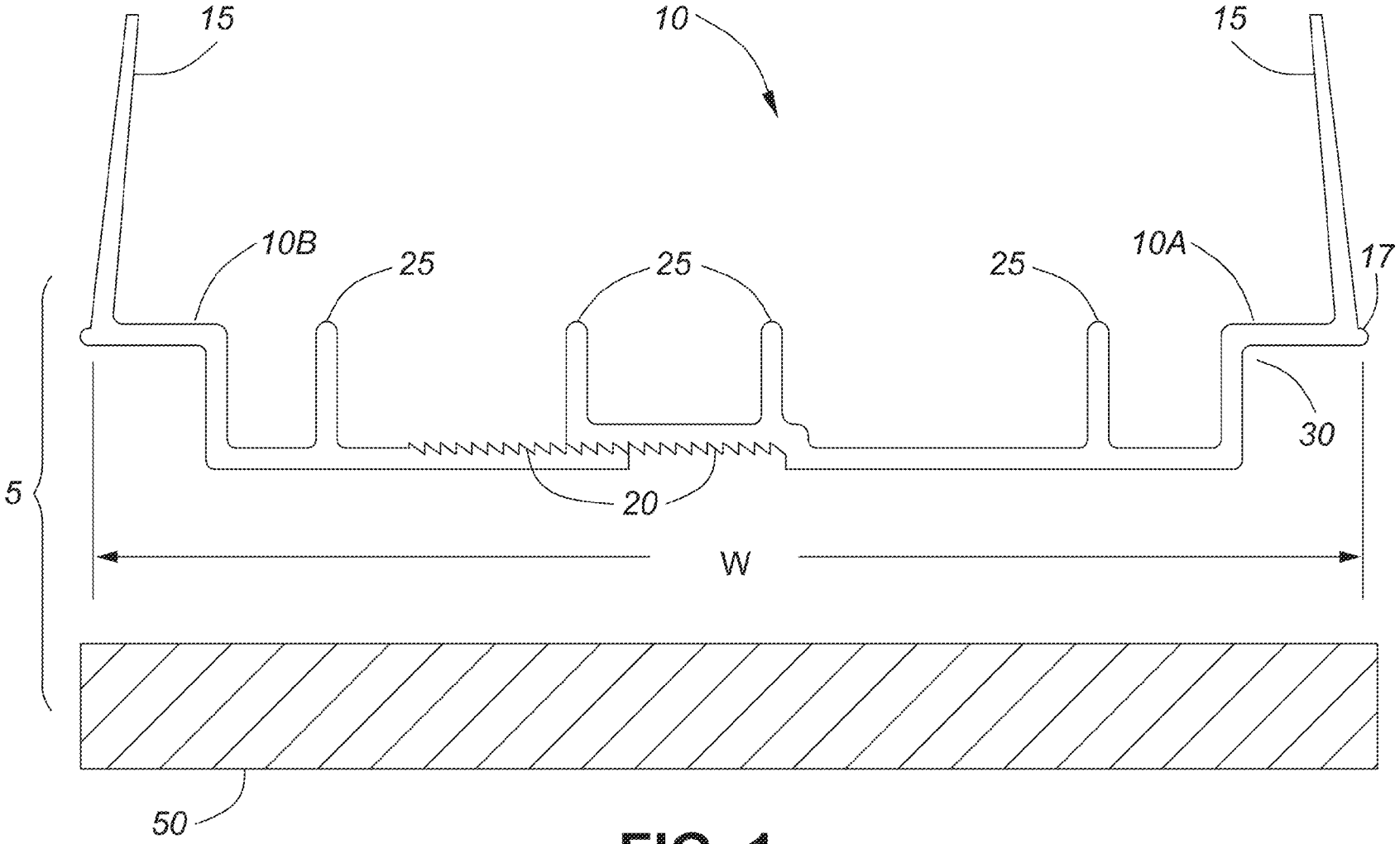
FIG. 1 illustrates an embodiment of the jamb system adapted for a doorway.

FIG. 1 illustrates an embodiment of the jamb system (5) adapted to a doorway, comprising a support member (10) and a jamb member (50).

In the embodiment shown in FIG. 1, the support member (10) comprises a first component (10A) and a second component (10B) which is affixed to the first component (10A) in a manner that allows the support member (10) to have a width 'W'.

The width 'W' can be varied by either: (1) adjusting the relative position between the first and second components (10A, 10B); or by (2) pre-fabricating the length of each component to a desired value.

As an example of the first type of width variation, the support member (10) can include a series of teeth or grooves (20) on each component (10A, 10B). The components (10A, 10B) are then joined together via one or more of the teeth/grooves (20). For example, the teeth (20) shown in FIG. 1. The width 'W' can then be varied by changing the relative position between the two components (10A, 10B). As shown in FIG. 1, for example, each component can engage every $1/16^{th}$ of an inch. The width 'W' of the support member (10) is adjustable, in order to accommodate varying thicknesses of the drywall/stud combination (shown in FIG. 5).

Alternatively, the width 'W' of the support member (10) may be adjusted by friction fit (not shown) between the two components (10A, 10B). There are other methods known in the art which allow for relative engagement of the two components.

Whether a friction fit, or teeth, are used to affix the two components (10A, 10B), either method allows for a variation of the total width 'W', from about ½ inch to about 1 inch. It is appreciated that the variation interval due to the locking mechanism is not fixed per se. Such width variation, as allowed by the teeth or friction fit, is usually used to accommodate differences in drywall thickness.

Figure 1A:
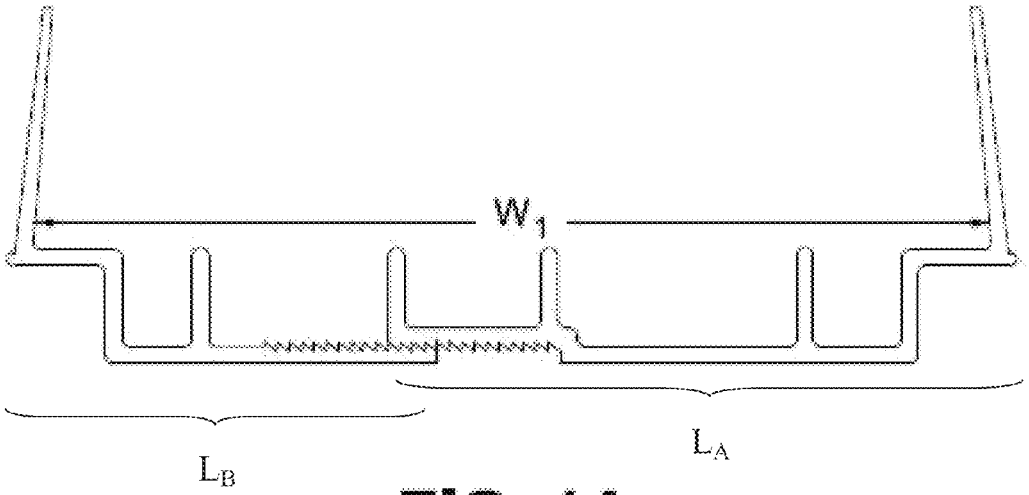
FIGS. 1A and 1B illustrate a variation of the width of the embodiment shown in FIG. 1.
Figure 1B:
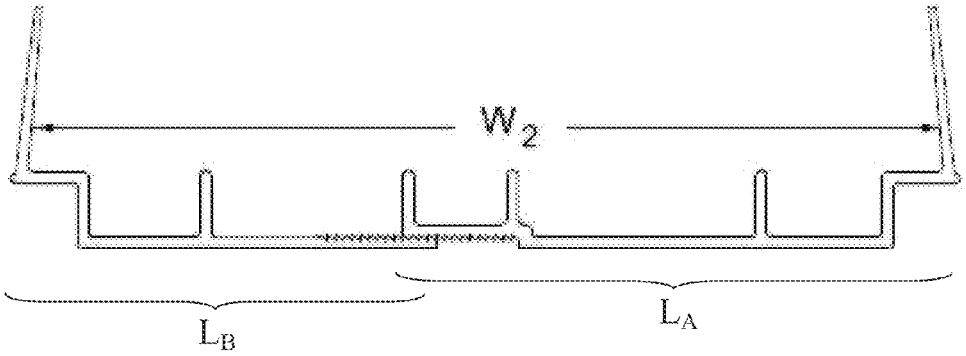

The width 'W' of the support member (10) can also be altered by a variation of the length of one or both components (10A, 10B). This is shown as $L_A$ and $L_B$ in FIGS. 1A and 1B. In FIG. 1A, the sum of $L_A$ and $L_B$, minus the overlap, gives a total width $W_1$. In FIG. 1B, the sum of $L_A$ and $L_B$, minus the overlap, gives a total width $W_2$, which is distinct from $W_1$. In both Figures, the overlap length is identical. However, the length of each component (10A, 10B) has been changed, giving rise to a different total width. The variation in length of either $L_A$ or $L_B$ is usually greater than the variation in length allowed by the locking mechanism between each component (10A) and (10B). That is, the locking mechanism between the two components (10A, 10B) allows for a variation in the width 'W' of about a maximum of about 1 inch, whereas the length of each component can be fabricated to vary more than a combined total of 1 inch. To achieve a greater variation in width 'W', the length of one or both components ($L_A$ and/or $L_B$) can be precut to a desired length.

Different lengths $L_A$ and $L_B$ allow for the accommodation of different sizes of the frame member between the drywall, such as 2×4, 2×6, 2×8, 2×10, or any masonry equal to or greater than 20 inches. For example, the length of one or both components (10A, 10B) can be changed in order to use the jamb system for a 2×6 frame member, as opposed to a 2×4 frame member. FIGS. 1A and 1B each illustrate an embodiment in which the length of each component (10A, 10B) is changed, to provide a larger width of the support member. Another example includes the case where an addition is being added in the presence of masonry wall, in which case, the overall width of the support member can be up to 11 to 12 inches On the other hand, the width for condominium walls (which are narrower than the standard 2×4 stud) can be as little as 3½ inches. It is understood that the width of the jamb system can be altered (either via the locking mechanism alone, or in combination with the locking mechanism and length of each support member component) to accommodate any size of wall thickness.

In an alternate embodiment, the two components (10A, 10B) are not directly affixed together, but held in place by the attachment of the wing members to the drywall/frame system (see below).

The support member may have a series of ribs (25) along the width thereof, in order to provide mechanical stability. Such an embodiment may be used when the jamb system is used to support a heavy and/or tall door.

The support member may have a reveal (30) of any suitable shape. For example, the reveal may be right-angled, curved, or the like. In FIG. 1, a right-angled reveal (30) is shown, while in FIG. 9, a curved reveal (80) is shown.

The support member can be made of polyvinyl chloride, acrylonitrile butadiene styrene (ABS), fibreglass, steel, aluminum or other similar material.

Figure 2:
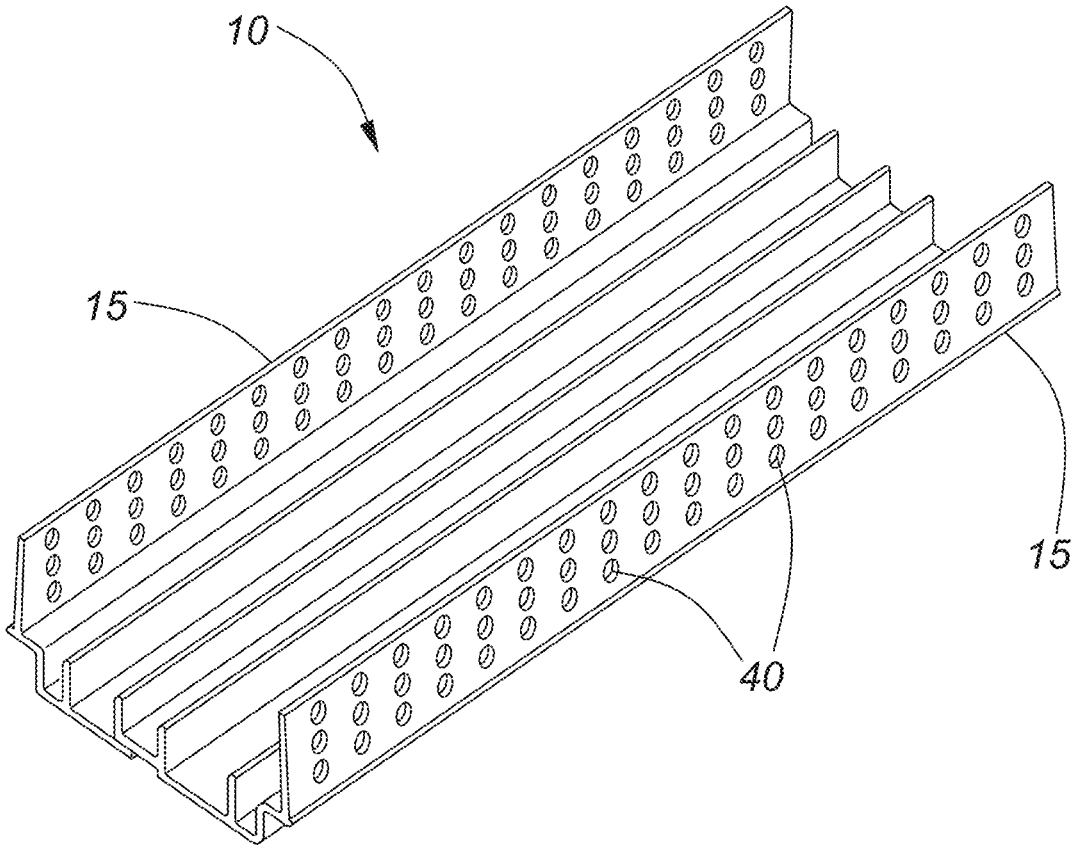
FIG. 2 illustrates a perspective view of the embodiment shown in FIG. 1.

In addition, the support member (10) includes a wing member (15) at each width extremity thereof. The wing member (15) is used to attach the jamb system (5) to drywall. Each wing member (15) may include a series of apertures (40), as shown in FIG. 2. The apertures (40) allow for the drywall compound (e.g. drywall mud, or the like) to adhere while also covering screws/nails that may be used to attach the wing member (15) to the drywall and frame member. Furthermore, each wing member may have at its base, a ridge or flange member (17), which serves as barrier against a drywaller's trowel, thereby preventing drywall compound (e.g. mud) from accidentally adhering to the reveal (30).

The jamb member (50) may be any material suitable for a door frame or door arch. As an example, the jamb member (50) may be made of wood, fibre board, metal, or similar material. Where the jamb system is used to support a door, the jamb member is of a strength suitable to support the door via hinges.

Figure 3:
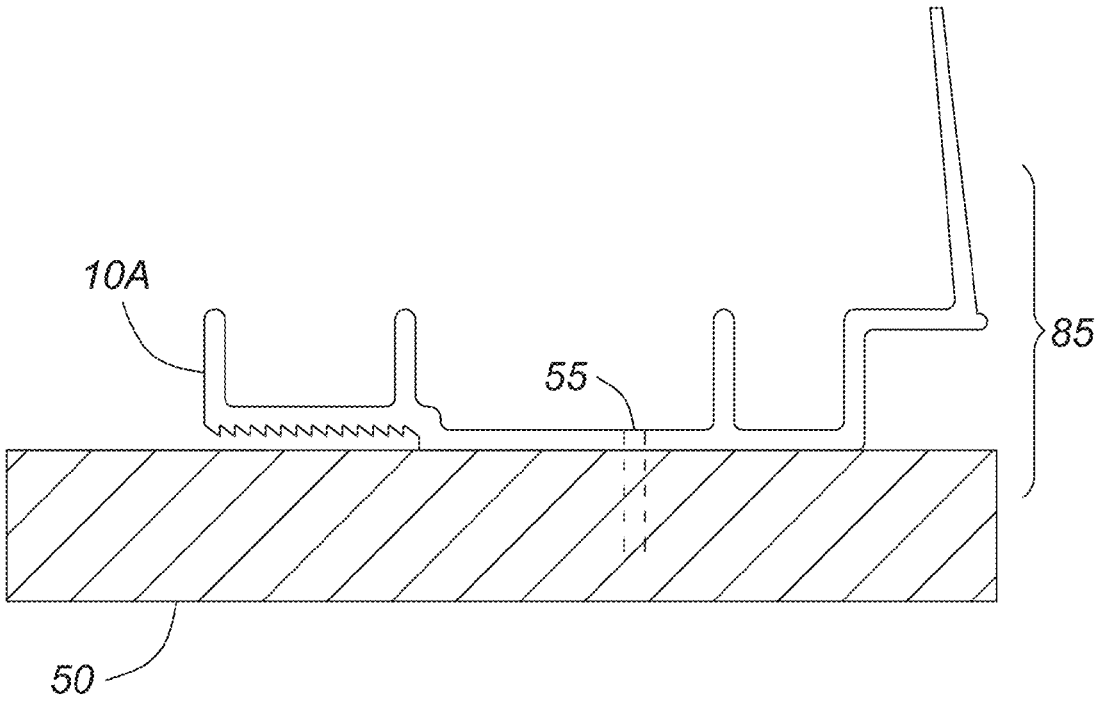
FIG. 3 illustrates placement of a component of the embodiment shown in FIG. 1.
Figure 9:
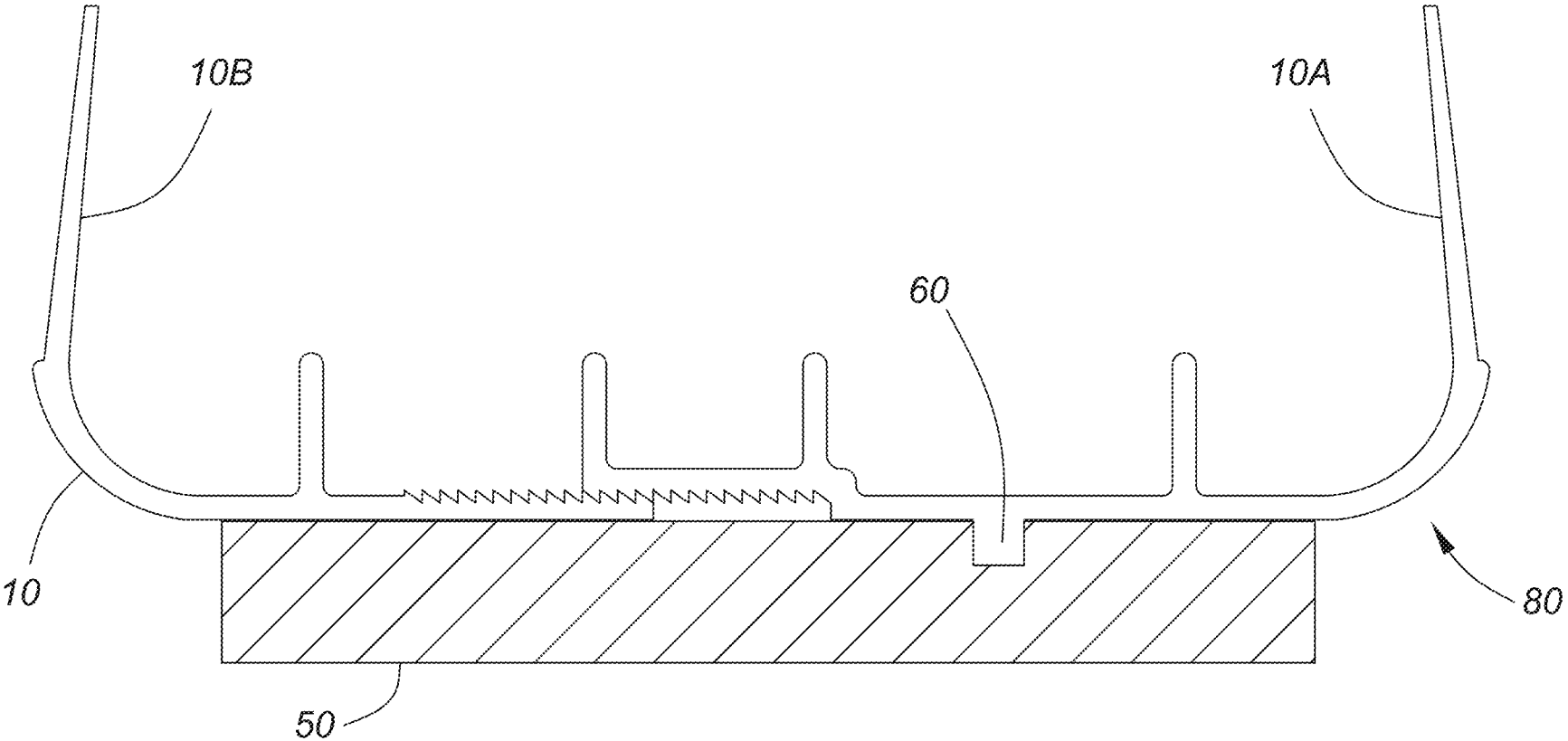
FIG. 9 illustrates a second embodiment of the jamb system adapted for a doorway.

The jamb system (adapted for doorways) is assembled as follows. As shown in FIG. 3, first component (10A) is affixed to the jamb member (50), using, for example, a screw or nail (55) which is inserted anywhere along the width of component 10A (except through the teeth). The result is the half-assembled system (85). Alternatively, component (10A) can be affixed to the jamb member (50) using an adhesive or staple. Or, as shown in FIG. 9, component (10A) can include an insert (60) which is fitted into a cavity (65) in the jamb member (50). The insert (60) and cavity (65) help to line up the plane of the reveal and the edge of the jamb member with the drywall.

Figure 4:
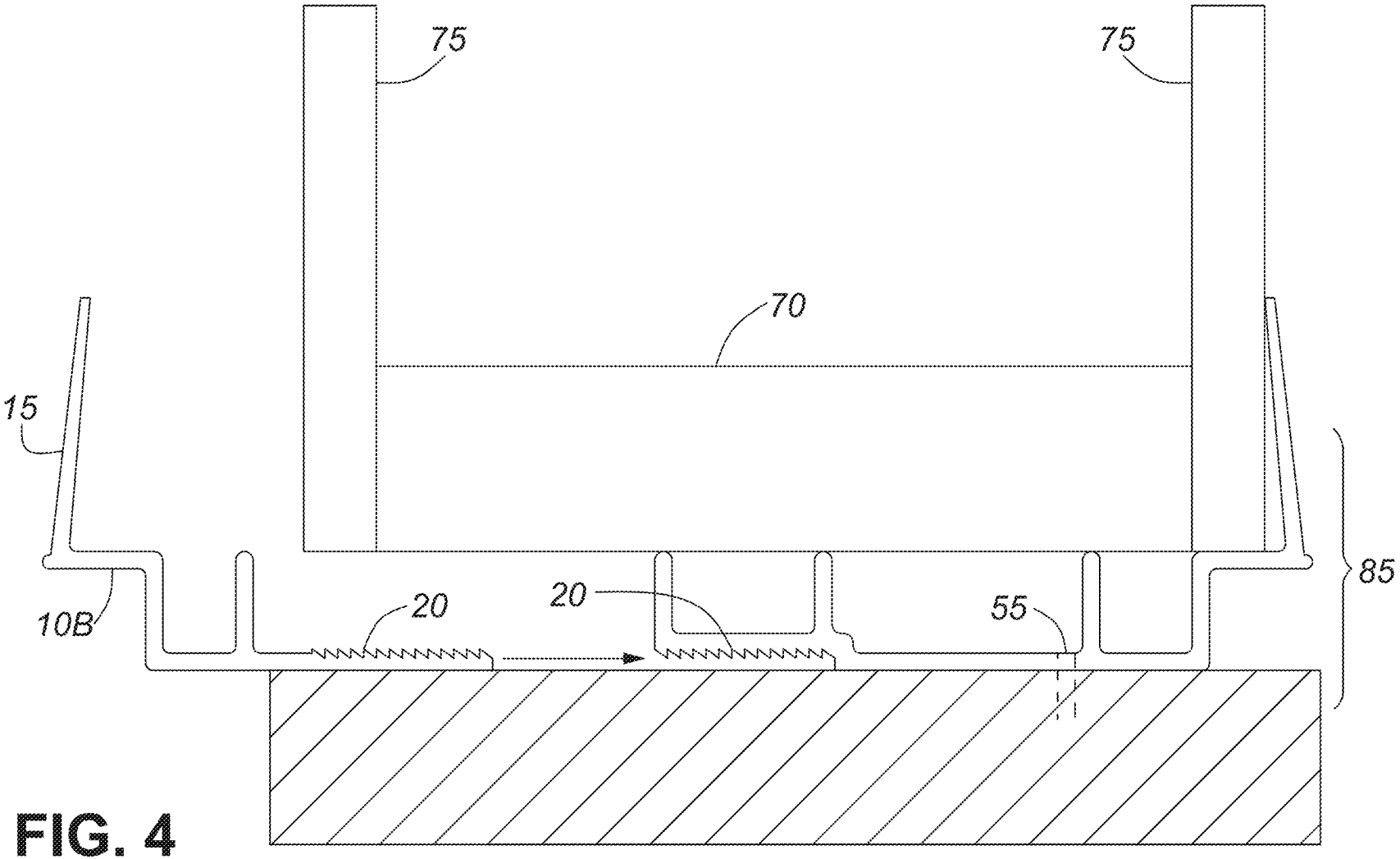
FIG. 4 illustrates placement of a complimentary component of the embodiment shown in FIG. 1.

As shown in FIG. 4, the half-assembled system (85) is then aligned to a wall stud (70) and surrounding drywall (75). The second component (10B) is then inserted into the half-assembled system (85), and attached thereto and "locked" via the series of teeth (20). Alternatively, where friction fit is used, the second component (10B) is inserted into the half-assembled system (85) until it fits into a cavity in component (10A), thereby "locking" the two components together. The second component (10B) is inserted so as to have its wing member (15B) flush with the drywall (75). The completed assembly is shown in FIG. 5.

Figure 5:
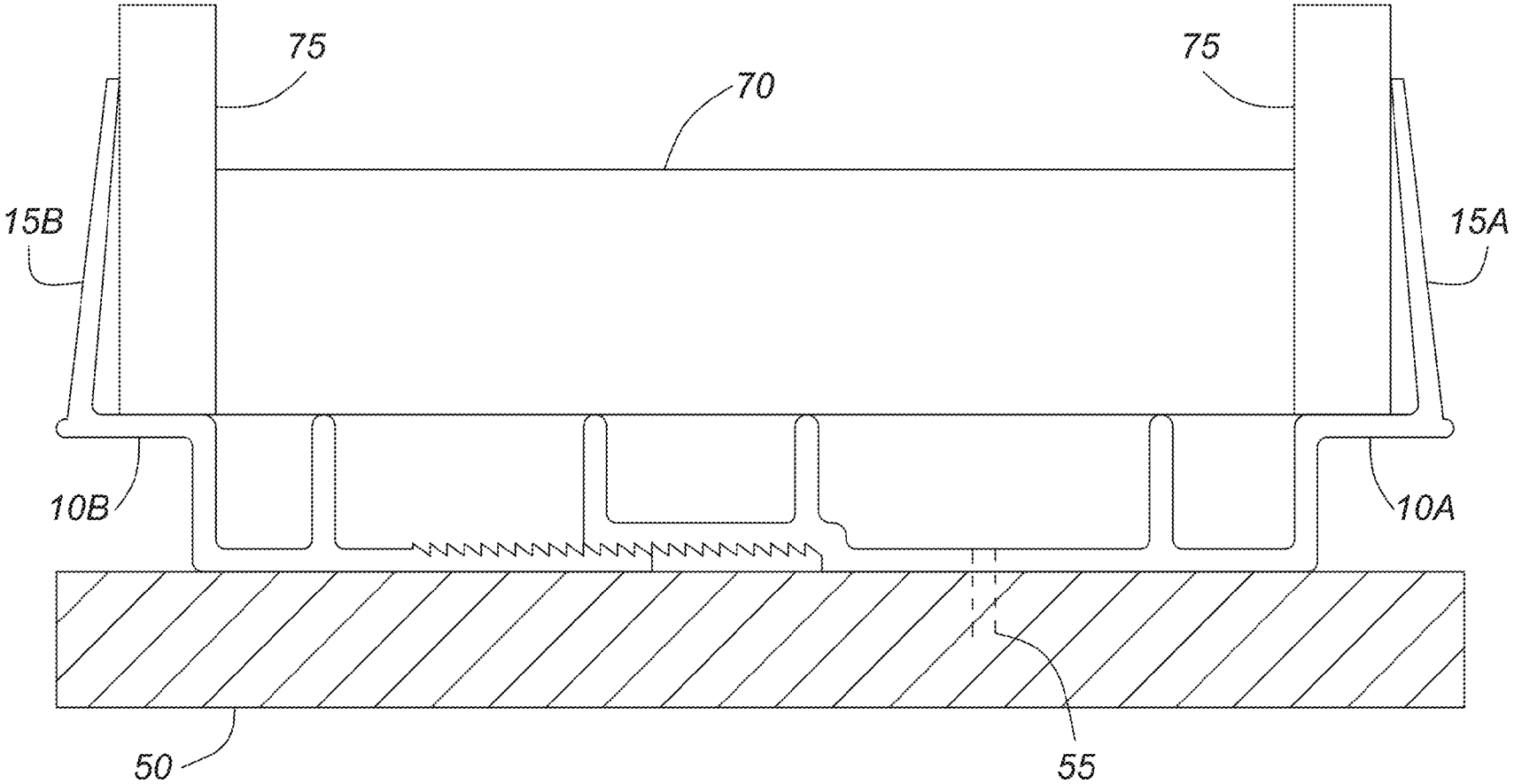
FIG. 5 illustrates a cross-sectional view of full assembly of the components of the embodiment shown in FIG. 1.

While FIG. 5 illustrates a slight gap between each wing member (15A, 15B) and the drywall (75), it is understood that one or both wing members (15A, 15B) can be constructed so as to be flush against the drywall (75); i.e. to leave no gap between the inner surface of the wing member (15A, 15B) and the drywall (75).

Figure 6:
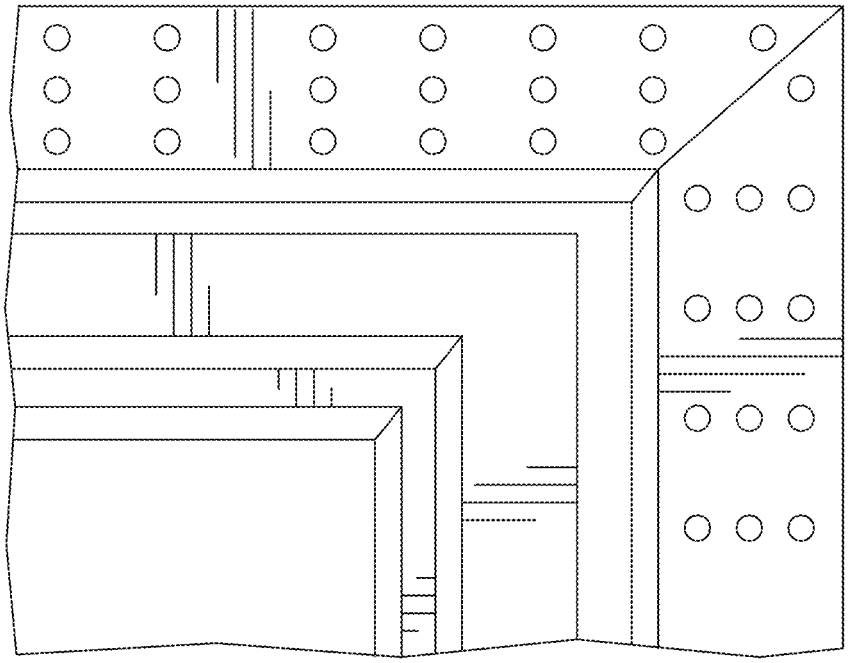
FIG. 6 illustrates full assembly of the components of the embodiment shown in FIG. 1.

Attachment of the jamb system (5) to the drywall (75) and stud (70) can be achieved by use of a drywall compound applied to the wings and drywall. In addition, one or more screws or nails, or any other method known in the art, may be used to fasten the wings to the drywall and frame member through one or more of the apertures of the wing members (15). For example, both components (10A, 10B) can be screwed through the wing members (15A, 15B), through the drywall (75) and into rough frame or stud (70). The jamb system may also be fastened via a face (or finishing) nail or screw through the jamb member. This nail can be hidden by a doorstop or hinge. FIG. 6 illustrates the assembled product.

Figure 8:
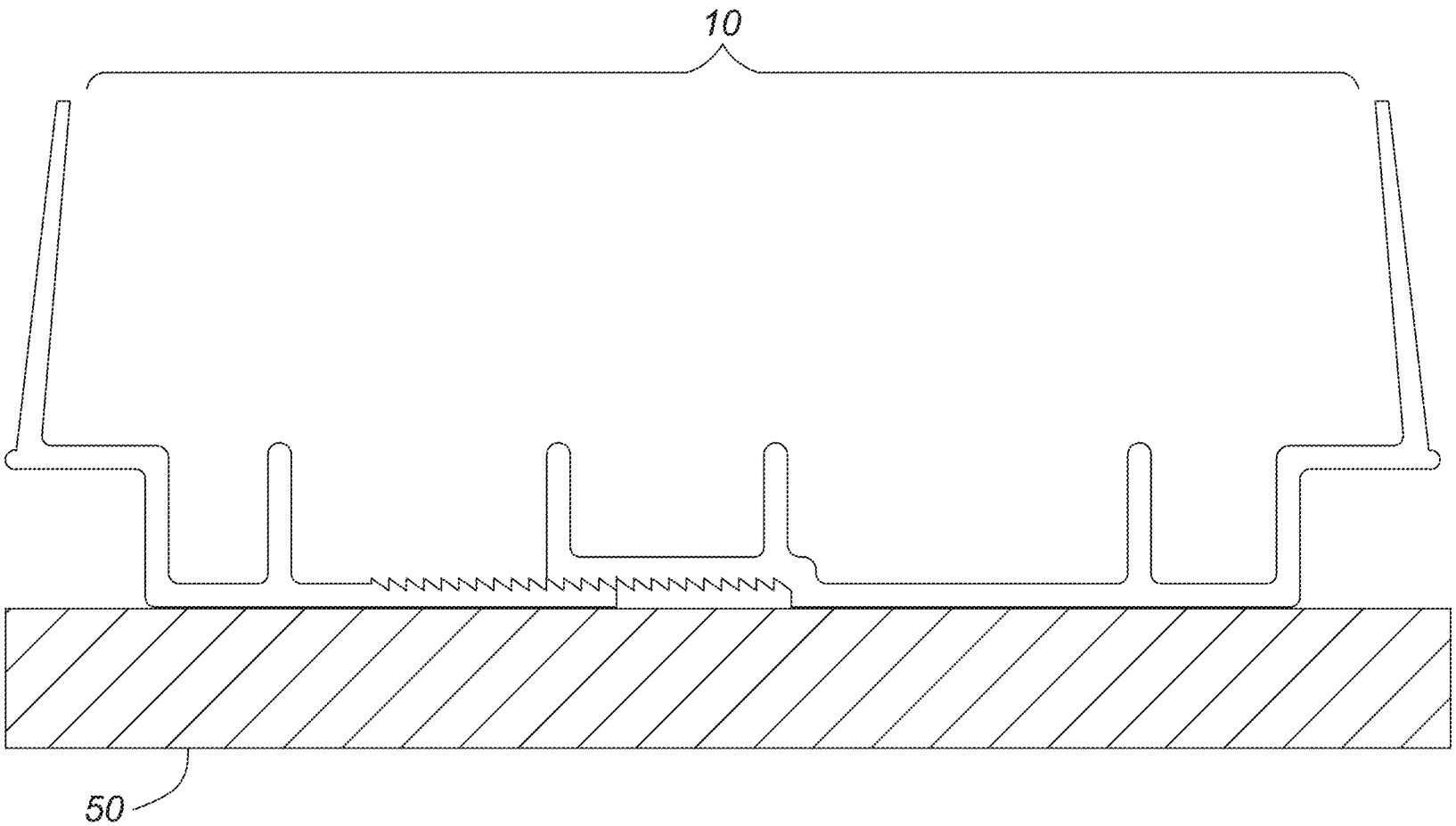
FIG. 8 illustrates a variation of the embodiment shown in FIG. 5.

The width 'W' of the support member (10) may be flush with the width of the jamb member (50), as shown in FIG. 5. Or the jamb system may be customized to have the width of the support member (10) greater than that of the jamb member (50), as shown in FIG. 8. Alternatively, the support member (10) may have a width less than that of the jamb member (50).

Figure 7:
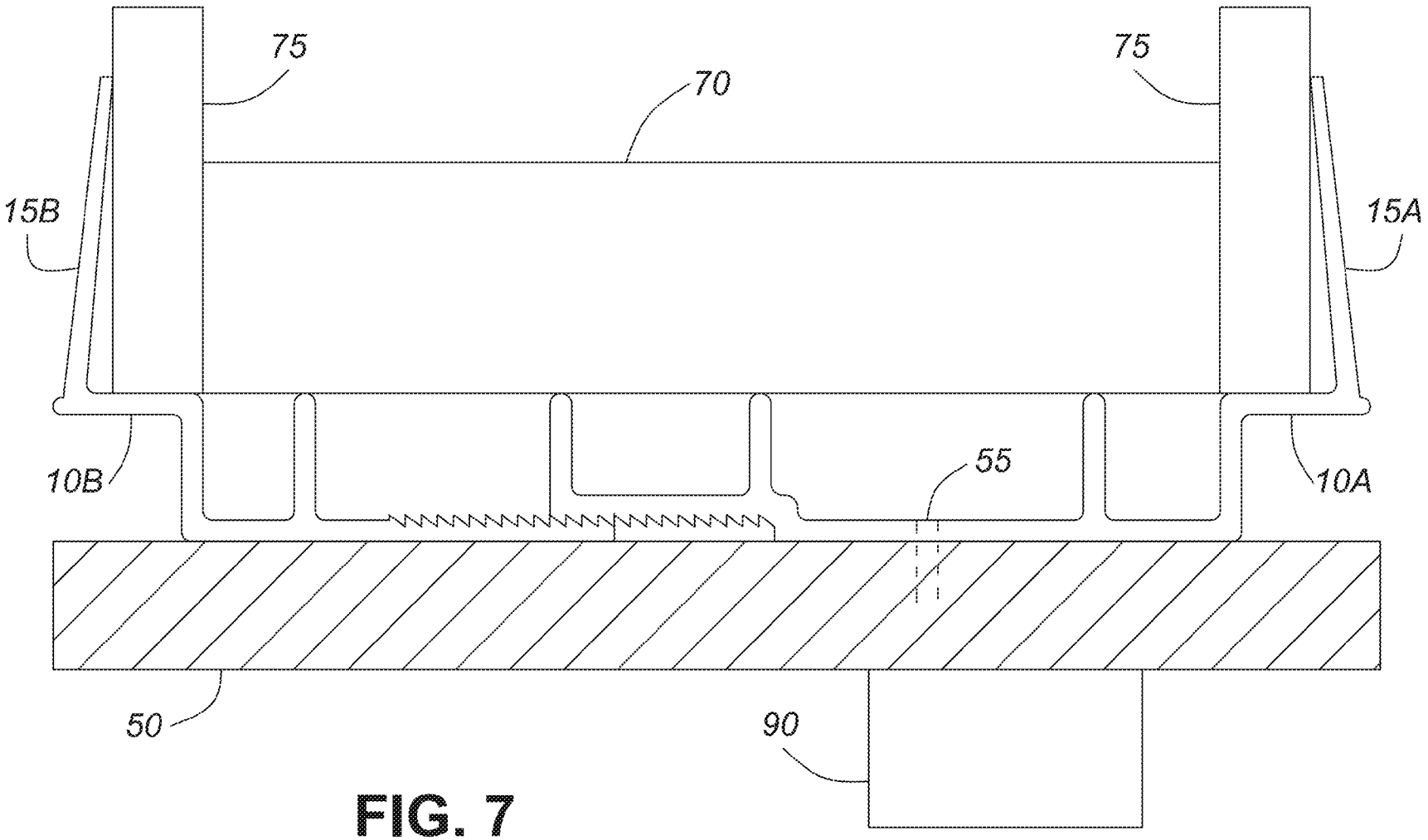
FIG. 7 illustrates a variation of the embodiment shown in FIG. 6.

In addition, a door stop (90) may be added along the length of the jamb member (507), if needed, as shown in FIG. 7.

Figure 10:
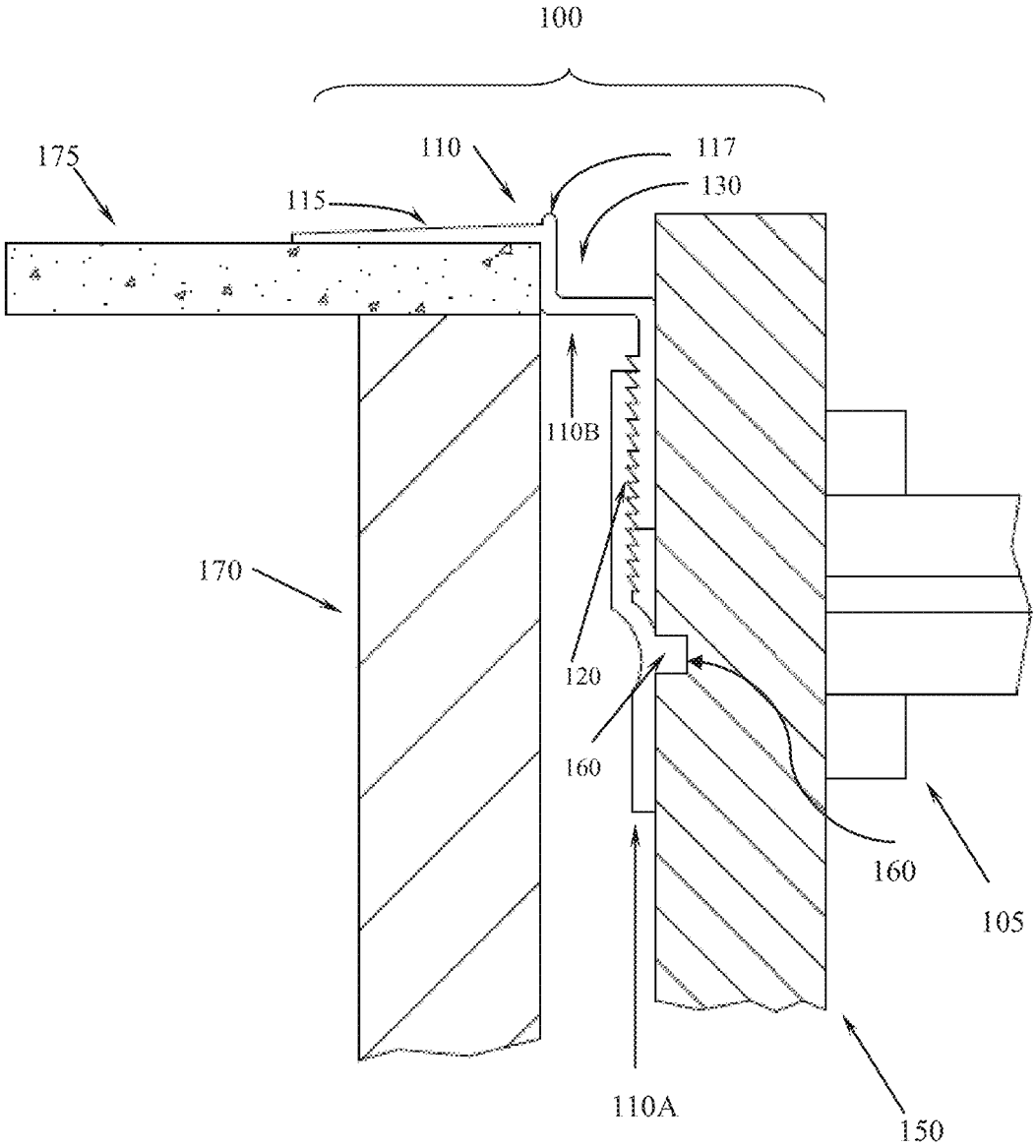
FIG. 10 illustrates a third embodiment of the jamb system adapted for a window assembly.

FIG. 10 illustrates a third embodiment of a jamb system (100) adapted to a window assembly (105), comprising a support member (110) and a jamb member (150).

The support member (110) comprises a first component (110A) and a second component (110B) which is affixed to the first component (110A). The first component (110A) is affixed directly to the jamb member (150), while the second component (110B) slides in directly adjacent to the jamb member (150), and engages the first component (110A) via series of teeth (120). It is understood that the two components (110A, 110B) can engage via other mechanisms known in the art (for example, but not limited to, friction fit). The two components can be engaged such that the relative position between the two can alter in a manner similar to the embodiments shown in FIGS. 1 through 9.

In the window assembly (105) shown in FIG. 10, only one drywall (175) is adjacent the wall stud (170). As such, component (110B) includes a wing member (115) at an extremity thereof. The wing member (115) is used to attach the jamb system (100) to the drywall (175). As in the other embodiments, the wing member (115) may include a series of apertures (as shown in FIG. 2). The apertures allow for the drywall compound (e.g. drywall mud, or the like) to adhere while also covering screws/nails that may be used to attach the wing member (115) to the drywall (175). Furthermore, the member (115) may have at its base, a ridge or flange member (117), which serves as barrier against a drywaller's trowel, thereby preventing drywall compound (e.g. mud) from accidentally adhering to the reveal (130). The ridge (117) may line up with the end of the jamb member (150).

The jamb system (adapted for a window assembly) is assembled as follows. The first component (110A) includes an insert (160) which is fitted into a cavity (165) in the jamb member (150). The insert (160) and cavity (165) help to line up the plane of the reveal and the edge of the jamb member with the drywall (175). It is understood that component (110A) may be affixed to the jamb member (150) in a different manner, as is known by an ordinary worker skilled in the art (for example, but not limited to, adhesive, screw, staple, nail, etc).

The second component (110B) is then inserted directly adjacent the jamb (150), beneath component (110A), and attached thereto and "locked" via the series of teeth (120). Alternatively, where friction fit is used, the second component (110B) is inserted into the half-assembled system until it fits into a cavity in component (110A), thereby "locking" the two components together. The second component (110B) is inserted so as to have its wing member (115) flush with the drywall (175).

While FIG. 10 illustrates the wing member (115) flush against the drywall (175), it is understood that the wing member (115) can be constructed such that there is a slight gap between the wing member (115) and the drywall (175).

Attachment of the jamb system (100) to the drywall (175) and stud (170) can be achieved by use of a drywall compound applied to the wing (115) and drywall (175). In addition, one or more screws or nails, or any other method known in the art, may be used to fasten the wing (115) to the drywall (175) one or more of the apertures of the wing member (115). For example, component (110B) can be screwed through the wing member (115) through the drywall (175) and into rough frame or stud (170). The jamb system (100) may also be fastened via a face (or finishing) nail through the jamb member (150). This nail can be hidden by a doorstop or hinge.

While the embodiment shown in FIG. 10 illustrates the first component affixed directly to the jamb member, and the second component sliding into the space between the first component and the jamb member, it is also contemplated to have the second component (which includes a wing member) to be directly affixed to the jamb member, and the first component to slide and engage with the second component, as described above.

The jamb member (150) may be any material suitable for a window assembly As an example, the jamb member (150) may be made of wood, fibre board, metal, or similar material.

CONCLUSION

The foregoing has constituted a description of specific embodiments showing how the apparatus may be applied and put into use. These embodiments are only exemplary. The apparatus in its broadest, and more specific aspects, is further described and defined in the claims which now follow.

The invention claimed is:

1. A jamb system adapted to a doorway being defined by a wall stud with surrounding drywall, the jamb system comprising a jamb member; and a support member of variable width, the support member being positionable adjacent to the wall stud with the surrounding drywall, and the support member being attachable to the jamb member in such a way that the jamb member faces an interior of the doorway once attached to the wall;

a wing member at each width extremity of the support member, each wing member being configured to attach the support member to the drywall surrounding the wall stud;

a flange member at each said width extremity of the support member extending in a direction generally perpendicular to the drywall surrounding the wall stud and configured to provide barrier against a dry walling trowel;

wherein the jamb member is affixed to the support member with a fastener and a reveal is produced between the support member and the jamb member.

2. The jamb system of claim 1, wherein each said wing member has a base attached to a respective instance of the flange member.

3. The jamb system of claim 2, further comprising:

a series of ribs along the width of the support member, and configured to provide mechanical stability once the support member is positioned to the wall stud with the surrounding drywall.

4. The jamb system of claim 1, wherein:

the reveal includes any one of a right-angled reveal and a curved reveal.

5. The jamb system of claim 1, wherein:

the jamb member defines a cavity; and the support member includes:

an insert fitted into the cavity of the jamb member in such a way that the insert and the cavity line up a plane of the reveal and an edge of the jamb member with the surrounding drywall.

6. The jamb system of claim 1, wherein:

the support member including includes:

a first component, and;

a second component being configured to be positioned relative to the first component in such a way that the support member has a width 'W' that is adjustable by changing a relative position between the first component and the second component in order to accommodate a thickness of the wall stud with the surrounding drywall.

7. The jamb system of claim 6, wherein:

the first component is configured to be affixed directly to the jamb member; and the second component is configured to be positioned between a portion of the first component and the jamb member, the second component is configured to lockingly engage with the first component.

8. The jamb system of claim 7, wherein:

the second component is directly adjacent to the jamb member; and the support member is affixable to the surrounding drywall.

* * * * *